US005379821A

United States Patent [19]

Pergolizzi et al.

[11] Patent Number: 5,379,821

[45] Date of Patent: Jan. 10, 1995

[54] SCREEN GUARD, AND SCREEN ASSEMBLY PROVIDED THEREWITH

[76] Inventors: James Pergolizzi; Marie D. Pergolizzi, both of 264 Helm La., West Bay Shore, N.Y. 11706

[21] Appl. No.: 879,759

[22] Filed: May 6, 1992

Related U.S. Application Data

[63] Continuation-in-part of Ser. No. 776,785, Oct. 11, 1991, abandoned, which is a continuation of Ser. No. 322,005, Mar. 13, 1989, abandoned.

[51] Int. Cl.[6] ..... E06B 3/30

[52] U.S. Cl. ..... 160/371; 49/462

[58] Field of Search ..... 160/371, 380, 403, 89, 160/90, 91; 49/460, 462

[56] References Cited

U.S. PATENT DOCUMENTS

| | | | |
|---|---|---|---|
| 1,810,510 | 6/1931 | Winne | 49/460 X |
| 2,489,072 | 11/1949 | Ausubel | 49/460 X |
| 3,834,077 | 9/1974 | Meyer | 49/460 X |
| 3,838,539 | 10/1974 | Gronowicz | 160/371 X |
| 3,916,838 | 11/1975 | Swart | 49/460 X |
| 4,330,022 | 5/1982 | Bull et al. | 49/462 X |
| 4,788,745 | 12/1988 | Wallis et al. | 49/460 X |

*Primary Examiner*—David M. Purol

*Attorney, Agent, or Firm*—Alfred M. Walker

[57] ABSTRACT

An element for protecting a screen against damage by fingers for example during grasping a handle, includes a main portion arranged to cover an area of the screen adjacent to the handle, and a mounting portion connected with the main portion and attachable to a screen carrier. The protective element is cantilevered over and spaced apart from the screen, so that the screen can move under adverse weather conditions without risk of tearing.

7 Claims, 1 Drawing Sheet

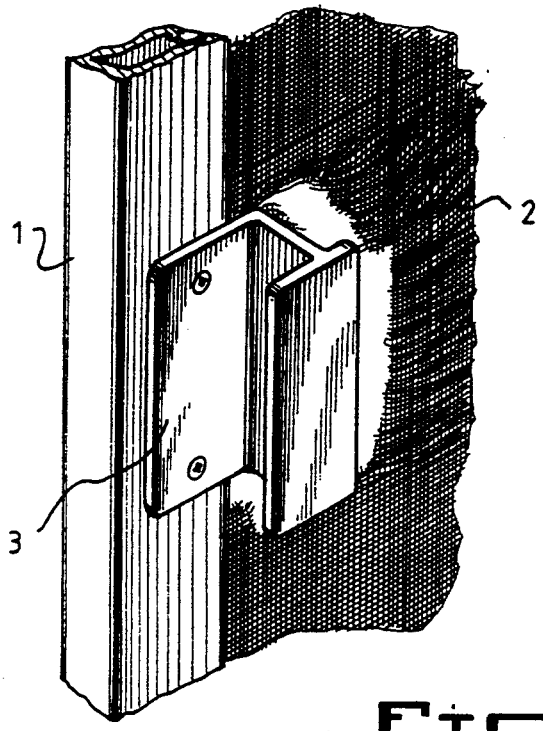
Fig. 1
Fig. 2
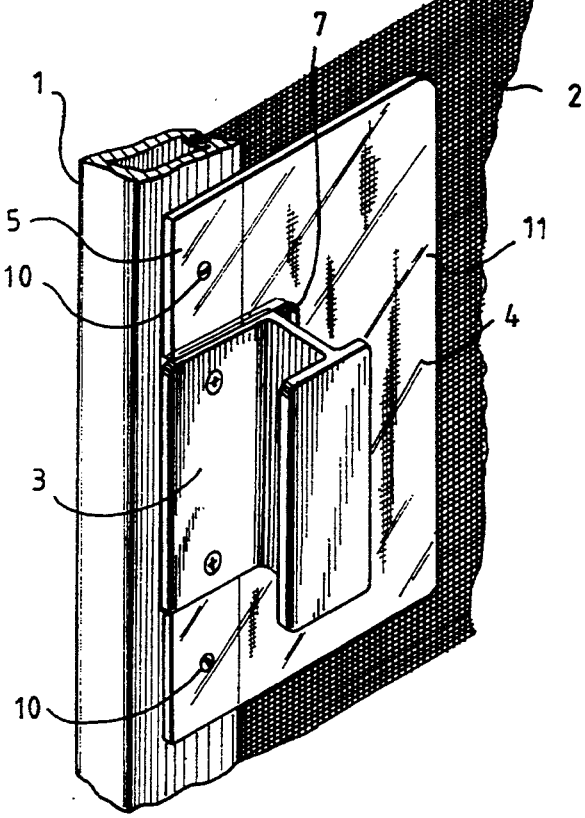
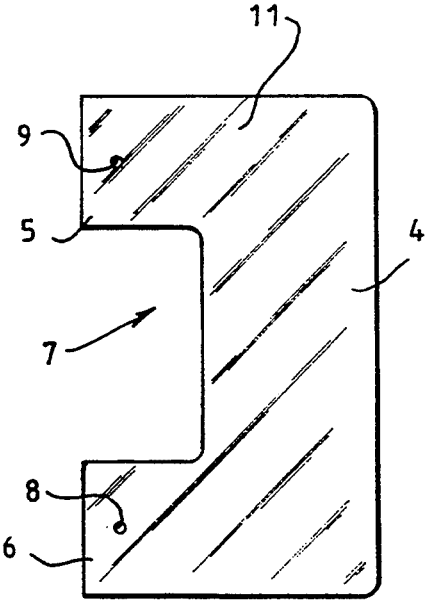
Fig. 3

SCREEN GUARD, AND SCREEN ASSEMBLY PROVIDED THEREWITH

This application is a continuation-in-part of application Ser. No. 07/776,785 filed Oct. 11, 1991 now abandoned, which is a continuation of application Serial No. 07/322,005 filed Mar. 13, 1989 now abandoned.

BACKGROUND OF THE INVENTION

The present invention relates to a screen guard or more particularly to an element for protecting a screen, such as a sliding screen and the like. In particular, the main portion guarding the screen is spaced apart from the screen.

Sliding screens as a rule include a screen carrier, a handle attached to the screen carrier, and a screen mounted in the screen carrier frame. During grabbing the handle by users for opening or closing the sliding screen the fingers of the users frequently miss the handle and pass through the screen or at least deform the screen. This causes damages and produces holes in the screen, and as a result the screen has to be repaired or exchanged. It is to be understood that it is highly desirable to eliminate the above specified damage to the screen.

DESCRIPTION OF THE PRIOR ART

The prior art includes U.S. Pat. No. 3,838,539 of Gronowicz, which includes a screen guard which is flush against a screen, and which is held in place by adhesive spots which bind the screen guard to the screen. The disadvantage of the Gronowicz '539 device is that the adhesive spots bind the guard to the screen, thereby interfering with the flexible resilience of the screen to turbulent or windy conditions. Because the Gronowicz '539 screen is adhesively bonded in place to the screen guard, the screen can rip and tear under stress along its edges adjacent to the screen guard. In effect, the Gronowicz '539 screen interferes with the stretchability of the screen under adverse inclement weather conditions.

Other prior art patents include U.S. Pat. No. 2,489,072 of Ausubel, which describes a protective door plate mountably fixed to a solid door, U.S. Pat. No. 4,330,022 of Bull, in which a screen is restricted in place between two opposite, overlaying pieces fastened to each other, U.S. Pat. No. 1,810,510 of Winne, which describes a fixed protector for an automobile door, U.S. Pat. No. 3,834,077 of Meyer for an extra protective safety plate for a door, U.S Pat. No. 3,916,838 of Swart for a flexible material panel hung from a door knob, and U.S. Pat. No. 4,788,745 of Wallis for a screen door handle in which a screen is also restricted in place between two opposite overlay pieces fastened to each other.

The disadvantages of the prior art, including especially Gronowicz, Bull and Wallis, is that the screen is restricted in place, whether by being adhesively bound to the screen guard, or restricted in place between two attached overlay pieces. As a result, there is considerable stress upon the screen material,increasing the possibility for the screen to rip or tear at the stress points of attachment to the guard.

In contrast, in the present invention the screen guard is attached only to the door frame, so that there is no direct mounting of the guard to the screen. Moreover, the thickness of the frame is greater than the screen, so an air space is provided between the guard and the screen.

Accordingly, it is an object of the present invention to provide an element for protecting a screen, and a screen assembly which avoids these disadvantages.

In keeping with these objects and with others which will become apparent hereinafter, one feature of the present invention resides, briefly stated, in an element for protecting a screen, which has a main part arranged to cantilever over and cover an area of the screen adjacent to a handle of a screen assembly, and a mounting part which is connected with the main part and attachable to a screen carrier, but which is separated apart from the screen.

When a screen assembly such as, for example, a screen door, is provided with the above described protecting element, the fingers of users during grabbing the handle cannot damage the screen, since if the fingers miss the handle, they will encounter the solid main portion of the inventive element and will not come into contact with the screen.

The novel features of the present invention are set forth in particular in the appended claims. The invention itself, however, will be best understood from the following description of a preferred embodiment, which is accompanied by the following drawings.

BRIEF DESCRIPTION OF THE DRAWINGS

FIG. 1 is a view which schematically shows a part of a screen door before installing a protective element of the present invention.

FIG. 2 is a view which substantially corresponds to the view of FIG. 1, but shows the screen door with the protective element in accordance with the present invention; and FIG. 3, is a side view of the protective element for screen, in accordance with the present invention.

DESCRIPTION OF A PREFERRED EMBODIMENT

As can be seen from FIG. 1, a screen assembly such as for example a sliding screen door has a screen carrier or frame 1, a screen 2 carried by the screen carrier 1 and mounted in the latter, and a handle 3 connected with the screen carrier. Frequently the fingers of the users miss the handle 3 during opening or closing the sliding screen door and as result deform or make holes in the screen 2, as shown in FIG. 1.

A protecting element 11 in accordance with the present invention is shown in detail in FIG. 3. It has a main portion which is identified with reference number 4. The main portion 4 is elongated in a first direction which will correspond to a vertical direction when the protecting element is installed. The protecting element 11 further has two mounting sections 5 and 6 which together form a mounting portion of the inventive protecting element 11. The main portion 4 and the mounting sections 5 and 6, which extend transversely to the main portion 4, form therebetween a recess 7. Each mounting section is provided with a mounting hole 8 and 9 respectively, for receiving a mounting screw. The element 11 is a one-piece integral structure.

As can be seen from FIG. 2, the protective element 11 in accordance with the present invention is installed so that the handle 3 is located in the recess 7 and the main portion 4 of the protecting element is cantilevered over, and covers the screen area located adjacent to the handle 3, yet is separate from the screen 2. The screws 10 are driven through the mounting holes 8 and 9 in the mounting sections 5 and 6 into the screen frame 1. For this purpose the screen can be provided with pre-drilled holes. The screen can be self-tapping metal or wood screws.

The guard 11 is made for a screen door having a frame 1 secured about the outer periphery of the screen 2, with a handle 3 secured to the frame. The substantially rectangular guard 11 has a handle recess 7 extending within the rectangular profile of the guard 11. The guard 11 is secured to the frame 2 of the screen door, with the handle recess 7 closely received about the handle 3, and the guard 11 is positioned in spaced relation away from the screen 2, such that the vertical portion 4 and the horizontal portions 5 and 6 protect the screen against damage by a user's hands when grasping the handle 3, while allowing the screen 2 to flex independently of the guard 11.

The corners of the rectangular guard 11 are rounded to avoid damage to the user's hand during use.

In the preferred embodiment, the guard apparatus 11 for a screen door having a frame 1 is secured about the outer periphery of the screen 2, with a handle 3 secured to the frame 1. Screen Guard 11 includes a substantially rectangular shape with rounded corners and a handle recess 7 extending within the rectangular profile of the guard 11, the guard 11, secured to the frame 1 of the screen door with the handle recess 7 closely received about the handle 3, and the guard 11 positioned in spaced relation away from the screen 2; wherein the guard apparatus 11 protects the screen 2 against damage by a user's hand when grasping the handle 3, while allowing the screen 2 to flex independently of the guard 11.

In accordance with another feature of the present invention the protecting element can be composed of a transparent material. In this case it is hardly noticed on the screen assembly and does not affect the appearance of the latter. The material can be plexiglass or acrylic resin.

The present invention is not limited to the details shown since various modifications and structural changes are possible without departing in any way from the spirit of the present invention.

What is desired to be protected by Letters Patent is set forth in the appended Claims.

We claim:

1. A screen guard assembly for a screen door having a frame secured about the outer periphery of the screen, with a handle secured to the frame comprising in combination:

a screen door having a screen and having a frame secured about the outer periphery of said screen, said frame having a thickness greater than that of a thickness of said screen, said frame having a handle secured to said frame and said handle overlapping a portion of said screen, a substantially rectangular guard with a handle recess extending within a rectangular profile of said guard, said guard secured to said frame of said screen door with said handle recess closely received about said handle, and said guard positioned cantilevered in spaced relation away from said screen.

2. The guard apparatus of claim 1, wherein the corners of the rectangular guard are rounded to avoid damage to the user's hand during use.

3. The guard apparatus of claim 1, wherein the rectangular guard is formed of a transparent material.

4. The guard apparatus of claim 3, wherein the transparent material comprises plexiglass.

5. The guard apparatus of claim 3, wherein the transparent material comprises acrylic resin.

6. The guard apparatus of claim 1, wherein at least one aperture is provided in the guard for securing the guard to the frame.

7. A screen guard assembly for a screen door having a frame secured about the outer periphery of the screen, with a handle secured to the frame, comprising in combination:

a screen door having a screen and having a frame secured about the outer periphery of said screen, said frame having a thickness greater than that of a thickness of said screen, said frame having a handle secured to said frame and said handle overlapping a portion of said screen, a substantially rectangular transparent guard with rounded corners and a handle recess extending within a rectangular profile of said guard, said guard secured to said frame of said screen door with said handle recess closely received about said handle, and said guard positioned cantilevered in spaced relation away from said screen;

wherein said guard apparatus protects said screen against damage by a user's hand when grasping said handle, while allowing said screen to flex independently of said guard.

* * * * *